US008596028B2

(12) United States Patent
Holzem et al.

(10) Patent No.: US 8,596,028 B2
(45) Date of Patent: Dec. 3, 2013

(54) METHOD AND MACHINE FOR PRODUCING RECLOSABLE PACKAGES

(75) Inventors: Dieter Holzem, Erolzheim (DE); Tieme Jan Slomp, Bad Gronenbach (DE); Guido Spix, Ulm (DE)

(73) Assignee: Multivac Sepp Haggenmuller GmbH & Co. KG, Wolfertschwenden (DE)

( * ) Notice: Subject to any disclaimer, the term of this patent is extended or adjusted under 35 U.S.C. 154(b) by 259 days.

(21) Appl. No.: 13/048,655

(22) Filed: Mar. 15, 2011

(65) Prior Publication Data

US 2012/0036815 A1 Feb. 16, 2012

(30) Foreign Application Priority Data

Aug. 11, 2010 (DE) ..... 10 2010 034 021

(51) Int. Cl.
*B65B 43/08* (2006.01)
*B65B 7/28* (2006.01)

(52) U.S. Cl.
USPC ..... 53/456

(58) Field of Classification Search
USPC ..... 53/471, 456, 467, 478, 484, 485, 486, 53/487, 173, 389.1, 559, 329, 329.2, 334, 53/341, 366
See application file for complete search history.

(56) References Cited

U.S. PATENT DOCUMENTS

| | | | | |
|---|---|---|---|---|
| 1,319,082 | A * | 10/1919 | Hulbert | 493/85 |
| 7,665,281 | B2 | 2/2010 | Send et al. | |
| 7,810,302 | B2 * | 10/2010 | Hinze et al. | 53/471 |
| 2007/0012708 | A1 * | 1/2007 | Send et al. | 220/784 |
| 2009/0313956 | A1 * | 12/2009 | Martinez Sampedro | 53/559 |
| 2010/0242411 | A1 * | 9/2010 | Boekstegers et al. | 53/449 |

FOREIGN PATENT DOCUMENTS

EP 0 791 538 A1 8/1997

OTHER PUBLICATIONS

German Examination Report Dated Mar. 29, 2011, Applicant MULTIVAC Sepp Haggenmueller GmbH & Co. KG, Application No. 10 2010 034 021.9-27 DI. 4 pages.

* cited by examiner

*Primary Examiner* — Hemant M Desai
(74) *Attorney, Agent, or Firm* — Husch Blackwell LLP

(57) ABSTRACT

The invention relates to a method for producing reclosable packages and to a deep-drawing packaging machine with an embossing station for embossing recesses into a top foil.

19 Claims, 4 Drawing Sheets

METHOD AND MACHINE FOR PRODUCING RECLOSABLE PACKAGES

CROSS-REFERENCE TO RELATED APPLICATIONS

This application claims foreign priority benefits under 35 U.S.C. §119(a)-(d) to German patent application number DE 102010034021.9, filed Aug. 11, 2010, which is incorporated by reference in its entirety.

TECHNICAL FIELD

The present disclosure relates to a method of producing reclosable packages as well as to a deep-drawing packaging machine for executing said method.

BACKGROUND

U.S. Pat. No. 7,172,779 B2 and DE 202005006262 U1 disclose packages which offer the possibility of reclosing the package by means of locking elements formed in the lower part of the package as well as in the lid, so as to guarantee that, when part of the products has been removed, the remaining part of the products in the package will be preservable for a sufficiently long period of time. The locking elements serve to confirm, by an audible snap, that the package is reclosed and to interconnect the two package halves such that, when the upper package half is raised, the lower package half cannot detach itself from the upper one in spite of the weight of the product.

U.S. Pat. No. 7,665,281 B2 and US 2007/0138192 A1 disclose a method in the case of which the locking elements are simultaneously formed in both package halves in a work station, when both said package halves have been closed in a sealing station of a deep-drawing packaging machine so as to form a hermetically sealed package. During this deformation process, the locking elements are produced by impressing embossing means into the sidewalls of both package halves into a counter-support. This method is not suitable for very stable hard foils used as a bottom foil (product tray).

On the contrary, the foils are subjected to cold forming in the area of the locking elements and this may lead to a formation of cracks and to indefinite differences in the wall thicknesses of the individual foils. This, in turn, may lead to leakiness and, consequently, to flaws in the package.

Another drawback is the high impressing force of the embossing means required for simultaneously cold forming both foils in common.

SUMMARY

It is an object of the present disclosure to provide a method for producing a reclosable package and a deep-drawing packaging machine for executing said method, in the case of which the above-described drawbacks can be eliminated.

A method for producing reclosable packages according to the present disclosure comprises the following steps: in a first forming station, package trays are formed in a bottom foil and, simultaneously, locking elements are formed in the sidewalls of the respective tray formed. The heating of the bottom foil required for this forming process is effected e.g. via one or a plurality of heating stations and/or a heating plate integrated in the forming station. Subsequently, the respective package trays formed are filled with products in an area of the product insertion track.

In a second forming station, a lid is formed in a normally slightly thinner top foil in such a way that flat surfaces are formed on the sidewalls of the lid, said flat surfaces covering the first locking elements of the package tray when said package tray and the lid have been combined.

The package tray filled with products and provided with locking elements is supplied to a sealing station together with the top foil or the lid formed, said sealing station welding the top foil or the lid formed to the package tray under a vacuum and/or a modified atmosphere whereby a hermetically sealed package is produced.

By means of a foil conveying system provided on both sides of the bottom foil, a group of packages, which are still interconnected through the bottom foil, is conveyed out of the sealing station and supplied to a downstream embossing station. In this embossing station, the top foil has embossed therein recesses, which match with the first locking elements of the package tray at least partially and which thus fulfill the requirement with respect to an audible snap when the package is being reclosed.

According to the present disclosure, the first locking elements are formed on at least two opposed sides of the package tray in the first forming station. In this respect, it will be advantageous to provide a plurality of locking elements or an elongate locking element per side of the package tray, said locking elements cooperating with at least two recesses in the lid. The locking elements may, however, be formed in the package tray on each side thereof or, in the case of round/oval packages, at an arbitrary location.

One variant of the method according to the present disclosure is so conceived that the locking elements of the package tray are configured such that they extend outwards, since this has hardly any negative influence on the forming process and since the forming tools need not have a more complicated structural design for this purpose.

In an embossing station, the embossing of recesses in the top foil is preferably carried out by means of a counter support on the outer surface of the package tray. According to an advantageous embodiment, the shape of the counter support corresponds in certain areas thereof to the shape of the locking elements of the package tray. The shape of the recesses may be complementary to that of the locking elements, but it may also deviate therefrom, so that the lid can be closed and/or retained in the closed position more easily.

A deep-drawing packaging machine according to the present disclosure provides a first forming station used for forming in a bottom foil at least one package tray and locking elements. The locking elements are adapted to be used for reclosing a package. In a second forming station of the deep-drawing packaging machine, a lid is formed in a top foil whereby flat surfaces are formed on the sides of the lid, said flat surfaces covering the locking elements of the package tray when said package tray and the lid have been combined. The deep-drawing machine comprises a product insertion region for inserting products into the package tray, and a sealing station for sealingly attaching the top foil or lid to the package tray. According to the present disclosure, an embossing station located downstream of the sealing station is configured for embossing into the top foil recesses which cooperate, at least in certain areas thereof, with the first locking elements formed in the package tray.

According to an advantageous embodiment, the embossing station comprises at least one embossing tool for embossing the recesses into the top foil and a counter support which cooperates with the embossing tool and the package. It will be particularly advantageous to hold the package during the embossing operation at least in certain areas thereof on the edge and in the area of the sealing seam, respectively, so as to counteract the force of the embossing tool applied to the package.

An inventive embodiment is so conceived that it comprises a forming station which is suitable for forming the locking elements of the package tray such that they extend outwards.

It proved to be particularly advantageous when the embossing tool moves in a pivoting direction of movement. Alternatively, the movement can take place in a combination of vertical and horizontal movements.

It will be advantageous to use a servomotor or a pneumatic cylinder as a drive for the embossing tool, since this also allows a continuously variable control of the penetration depth of the embossing tool in the top foil, whereby the reclosing characteristics of the package can be influenced. In particular the use of a pneumatic drive will be suitable for a maximum penetration depth of the embossing tool up to the counter support.

In the following, an advantageous embodiment of the present disclosure will be described in more detail making reference to the below drawings.

DETAILED DESCRIPTION

Figure 1:
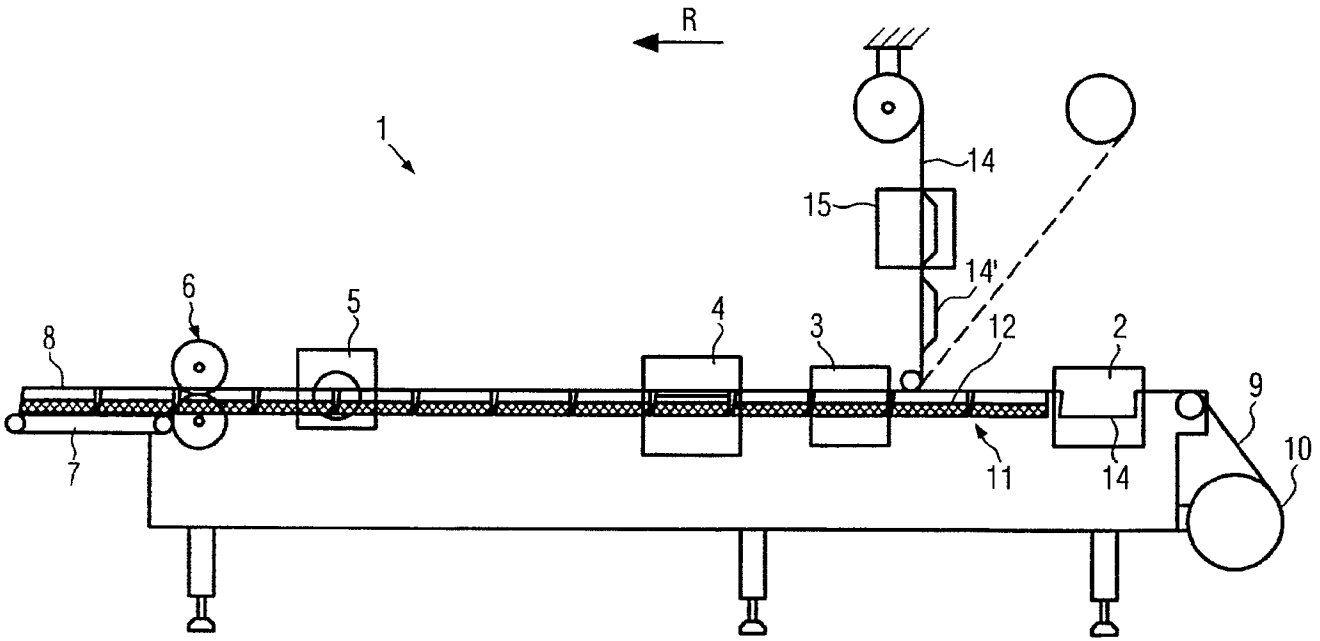
FIG. 1 shows a schematic side view of a deep-drawing packaging machine according to the present invention.

Identical components are always provided with identical reference numerals in the figures.

FIG. 1 shows a deep-drawing packaging machine 1 comprising a forming station 2, a sealing station 3, an embossing station 4, a cross-cutting unit 5 and a longitudinal cutting station 6. Via a conveying system 7, the packages 8 are conveyed out of the deep-drawing packaging machine 1. A bottom foil 9 is unwound from a foil holder 10 and intermittently conveyed in a conveying direction R through the deep-drawing packaging machine 1 by means of a foil advancement system, which is not shown. In an insertion area 11, the products 12 are inserted in a package tray 13, which was formed in the bottom foil 9 in the forming station 2. The package tray 13 having the product 12 inserted therein is supplied to the sealing station 3 together with a top foil 14, said top foil 14 being deep drawn in a top foil forming station 15 so as to form a lid 14'. The bottom foil 9 and the top foil 14 are welded to one another, preferably under a modified atmosphere or under a vacuum. An embossing station 4 following the sealing station 3 forms recesses in the lids 14' formed in the top foil 14, the geometry of said recesses corresponding in certain areas thereof to that of locking elements 16 (cf. FIG. 2*a*) of the package tray 13. The locking elements 16 of the package tray 13 are deep drawn on at least two opposed sides of the package tray 13 in the forming station 2 under the influence of temperature, pressure and/or a vacuum.

Figure 2B:
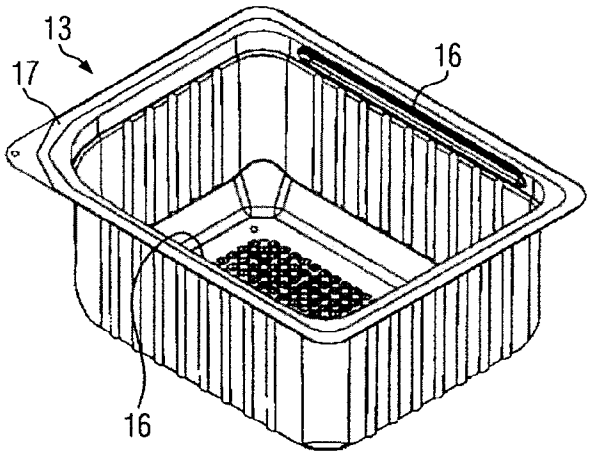
FIG. 2*b* shows a schematic view of a further package tray of a package.
Figure 2A:
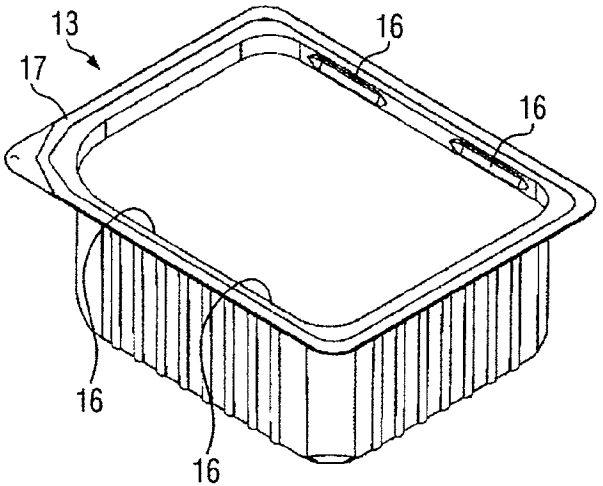
FIG. 2*a* shows a schematic view of a package tray of a package.

FIG. 2*a* shows a foil detail of a deep drawn package tray 13 (additional package trays in the foil compound are not shown) with two respective opposed locking elements 16. These locking elements 16 can be arranged parallel to or transversely to the conveying direction R or they may be provided on additional or on all sides. The locking elements 16 are preferably configured as a longitudinal groove, as shown in FIG. 2*b*, so as to guarantee the area and force required for audibly reclosing the package 8 by reinstalling the lid 14'. The area 17 extending along the edge of the package identifies the sealing of the top foil 14 to the bottom foil 9 and the package tray 13, respectively. When the package 8 is opened for the first time, said sealing is opened, i.e. detached in the area 17.

FIG. 2*b* shows a package tray 13 provided with continuous locking elements 16 extending parallel in the conveying direction R and arranged on both sides of the package tray 13.

Figure 3:
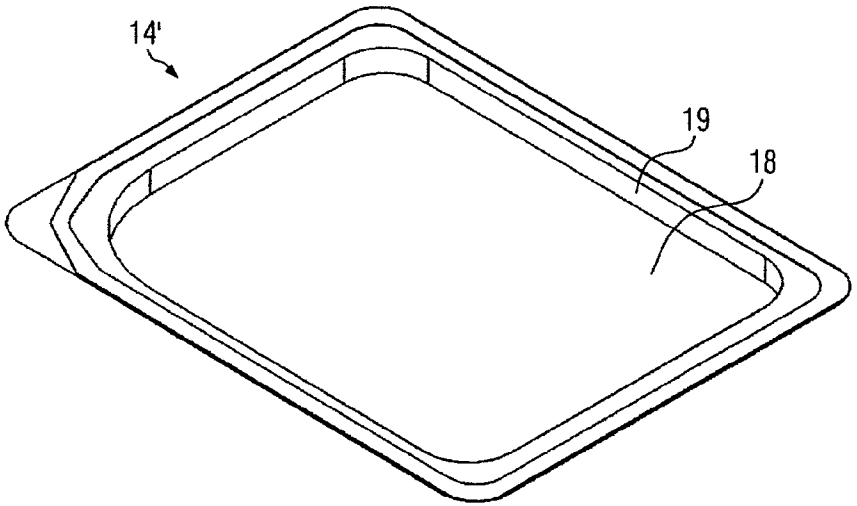
FIG. 3 shows a schematic view of a top foil of a package.

FIG. 3 shows a detail of the top foil 14 in a condition in which said top foil 14 has been formed in the lid forming station 15 such that a deep-drawn area 18 of the lid 14' can be installed in the open area of the package tray 13 whereby a lateral border 19 of the lid 14' comes into contact with the inner wall of the package tray 13 and abuts thereon in certain areas so as to produce a sealing effect between the interior of the package and the environment. The lateral border 19 of the lid 14' then covers the locking elements 16 of the package tray 13.

FIGS. 4*a* to 4*d* show various operating conditions of the embossing station 4 with embossing tools 20.

Figures 4A, 4B, 4C, 4D:
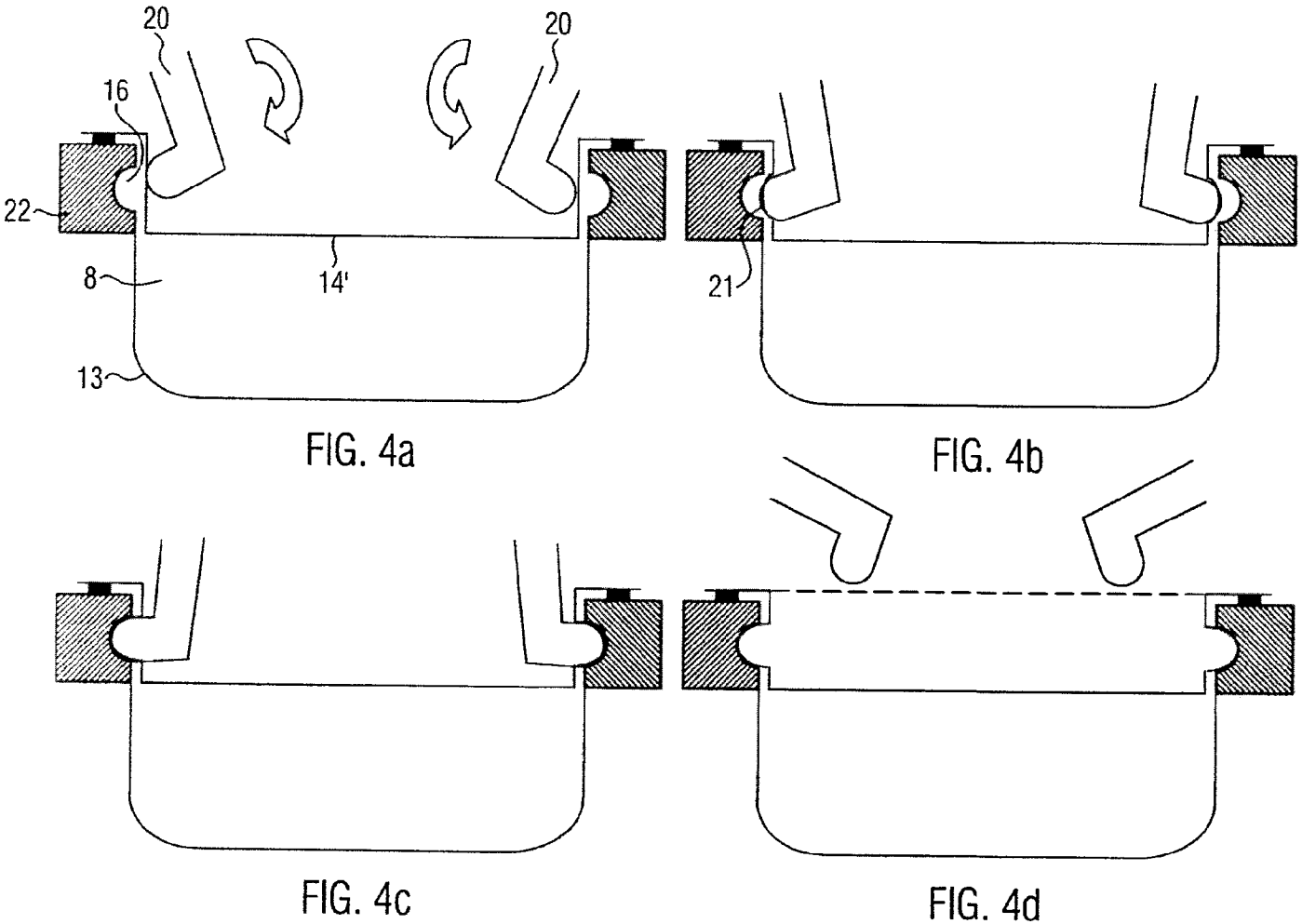
FIGS. 4*a*, 4*b*, 4*c* and 4*d* show schematic views of an embossing unit for forming recesses in the top foil.

In FIG. 4*a*, the package 8 consisting of the package tray 13 and the top foil 14 sealed thereto has been transported into the embossing station 4 by a conveying unit, which is not shown, and the embossing tools 20, which may also be heated, are pivoted into the area of the locking elements 16, which have already been formed in the bottom foil 9 in the forming station 2.

In FIG. 4*b* the embossing tools 20 continue their pivotal movement in the direction of the locking elements 16. In the course of this process, the top foil 14 is deformed outwards towards the package tray 13.

As shown in FIG. 4*c*, the embossing tool 20 pushes the top foil 14 into the locking element 16 to such an extent that the recess 21 in the top foil 14' comes, at least in certain areas thereof, into contact with the locking element 16 so as to obtain during opening and reclosing of the package 8 a perceptible effect with respect to a reliable and audible engagement between the locking element 16 and the recess 21.

A counter support strip 22 including a longitudinal groove oriented in the conveying direction R is configured in accordance with the shape of the locking element 16 and serves as a stop for the movement of the embossing tool 20.

For continuing the transport of the package 8, the embossing tools 20 are pivoted away from the package collision area, as can be seen in FIG. 4*d*, and the package 8 can be advanced to an optional labeller, which is not shown.

The locking element 16 may have the shape of a semicircle or of half an oval. A trapezoidal shape or a polygonal shape are, however, imaginable as well. This applies to the recess 21 as well.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of producing reclosable packages, the method comprising:

forming package trays in a bottom foil for accommodating products therein, wherein the package trays are formed with locking elements on sides of the package trays;

inserting products into the formed package trays;

forming lids in a top foil in such a way that flat surfaces are formed on sides of the lids, the flat surfaces of the lids covering the locking elements of the package trays when the package trays and the lids have been combined;

feeding the package trays, into which products have been inserted, and the lids to a sealing station;

closing the package trays with the top foil or lids in the sealing station; and embossing into the top foil recesses, which match with the locking elements at least in certain areas thereof, in an embossing unit located down-stream of the sealing station.

2. A method according to claim 1, wherein the locking elements of each package tray are formed on at least two opposed sides of the package tray.

3. A method according to claim 1, wherein the locking elements of each package tray are formed such that the locking elements extend outwards.

4. A method according to claim 1, wherein the embossing unit comprises a counter support positionable on an outer surface of each package tray.

5. A method according to claim 1, wherein the embossing unit comprises at least one pivotable embossing tool.

6. A method according to claim 5, wherein the embossing unit comprises at least one counter support that cooperates with the at least one embossing tool to form the recesses.

7. A deep-drawing packaging machine comprising:

a forming station for forming package trays in a bottom foil such that the package trays include locking elements, the locking elements being adapted to be used for reclosing packages that include the package trays;

a top foil forming station for forming lids in a top foil in such a way that flat surfaces are formed on sides of the lids, the flat surfaces covering the locking elements of the package trays when the package trays and the lids have been combined;

a product insertion region for inserting products into the package trays;

a sealing station for sealingly attaching the top foil to the package trays; and an embossing unit located downstream of the sealing station and configured for embossing into the top foil recesses which match, at least in certain areas thereof, with the locking elements formed in the bottom foil.

8. A deep-drawing packaging machine according to claim 7, wherein the embossing unit comprises at least one embossing tool for embossing the recesses into the top foil.

9. A deep-drawing packaging machine according to claim 8, wherein the embossing unit comprises at least one counter support for the at least one embossing tool.

10. A deep-drawing packaging machine according to claim 7, wherein the forming station is configured for forming the locking elements of the package trays such that the locking elements extend outwards.

11. A deep-drawing packaging machine according to claim 7, wherein the at least one embossing tool is pivotably supported.

12. A method of producing reclosable packages, the method comprising:

forming package trays in a first foil such that each package tray includes a locking element;

inserting products into the formed package trays;

forming lids in a second foil such that each lid includes a flat surface on a side of the lid, the flat surface of each lid being configured to cover the locking element of a respective package tray when the package tray and the lid have been combined;

feeding the package trays, into which products have been inserted, and the lids to a sealing station;

sealing each lid with a respective package tray at the sealing station; and embossing into each lid a recess at an embossing station located down-stream of the sealing station, such that each recess matches with at least a portion of the locking element of a respective package tray.

13. A method according to claim 12, wherein forming package trays is performed such that each package tray includes a locking element formed on each of at least two opposed sides of the package tray, forming lids is performed such that each lid includes a flat surface on each of at least two opposed sides of the lid, and embossing is performed such that each lid includes a recess in each flat surface, wherein each recess matches with at least a portion of one of the locking elements of a respective package tray.

14. A method according to claim 12, wherein the locking element of each package tray is formed such that the locking element extends outward.

15. A method according to claim 12, wherein the embossing station comprises at least one counter support positionable on an outer surface of each package tray.

16. A method according to claim 15, wherein the embossing unit further comprises at least one pivotable embossing tool that cooperates with the at least one counter support for forming the recesses.

17. A method according to claim 1, wherein forming lids in a top foil includes forming lids having one or more flat sides wherein substantially the entire flat side is a flat surface and said one or more flat sides cover the locking elements of the package trays when the package trays and the lids have been combined.

18. A deep-drawing packaging machine according to claim 7 wherein said top foil forming station forms lids having one or more flat sides wherein substantially the entire side is a flat surface and said one or more flat sides cover the locking elements of the package trays when the package trays and the lids have been combined.

19. A method according to claim 12 wherein forming lids in a second foil includes forming lids having one or more flat sides, wherein substantially the entire flat side is a flat surface, wherein the flat surface of each lid is configured to cover a locking element of a respective package tray when the package tray and the lid have been combined.

* * * * *